US011702847B2

(12) United States Patent
Bergelin et al.

(10) Patent No.: US 11,702,847 B2
(45) **Date of Patent: *Jul. 18, 2023**

(54) FLOORBOARDS COMPRISING A DECORATIVE EDGE PART IN A RESILIENT SURFACE LAYER

(71) Applicant: Välinge Innovation AB, Viken (SE)

(72) Inventors: Marcus Bergelin, Lerberget (SE); Mats Nilsson, Viken (SE)

(73) Assignee: VALINGE INNOVATION AB, Viken (SE)

( * ) Notice: Subject to any disclaimer, the term of this patent is extended or adjusted under 35 U.S.C. 154(b) by 9 days.

This patent is subject to a terminal disclaimer.

(21) Appl. No.: 17/351,480

(22) Filed: Jun. 18, 2021

(65) Prior Publication Data

US 2022/0112726 A1 Apr. 14, 2022

Related U.S. Application Data

(63) Continuation of application No. 16/569,894, filed on Sep. 13, 2019, now Pat. No. 11,066,836, which is a (Continued)

(30) Foreign Application Priority Data

Jan. 12, 2006 (SE) ..... 0600055-8

(51) Int. Cl.
*E04F 15/04* (2006.01)
*E04F 15/16* (2006.01)
(Continued)

(52) U.S. Cl.
CPC ..... *E04F 15/02033* (2013.01); *E04B 1/68* (2013.01); *E04C 2/16* (2013.01);
(Continued)

(58) Field of Classification Search
None
See application file for complete search history.

(56) References Cited

U.S. PATENT DOCUMENTS 213,740 A 4/1879 Connor
792,979 A 6/1905 Fulghum
(Continued)

FOREIGN PATENT DOCUMENTS

CA 1 237 344 5/1988
CN 2076142 U 5/1991
(Continued)

OTHER PUBLICATIONS

International Search Report issued in PCT/SE2007/000007, dated Mar. 21, 2007, Swedish Patent Office, Stockholm, SE, 5 pages.
(Continued)

*Primary Examiner* — Robert Canfield
(74) *Attorney, Agent, or Firm* — Buchanan Ingersoll & Rooney P.C.

(57) ABSTRACT

A set of essentially identical floorboards each including a front face and a rear face extending in the horizontal plane, a core, and a surface layer, a mechanical locking system is arranged at least at two opposite edges for connecting a floorboard with an adjacent floorboard in a horizontal and a vertical direction, said mechanical locking system being configured for connecting the floorboard with the adjacent floorboard by vertical folding, wherein one of said opposite edges is provided with a horizontally extending protrusion at an upper edge, and wherein said protrusion is configured to overlap a surface groove at an upper edge of the other of said opposite edges, such that two connected and adjacent floorboards have upper overlapping edges.

18 Claims, 6 Drawing Sheets

Related U.S. Application Data continuation of application No. 15/684,129, filed on Aug. 23, 2017, now Pat. No. 10,450,760, which is a continuation of application No. 14/946,080, filed on Nov. 19, 2015, now Pat. No. 9,765,530, which is a continuation of application No. 13/943,464, filed on Jul. 16, 2013, now Pat. No. 9,222,267, which is a continuation of application No. 13/552,357, filed on Jul. 18, 2012, now Pat. No. 8,511,031, which is a continuation of application No. 13/046,011, filed on Mar. 11, 2011, now Pat. No. 8,245,478, which is a continuation of application No. 11/649,837, filed on Jan. 5, 2007, now Pat. No. 7,930,862.

(60) Provisional application No. 60/758,213, filed on Jan. 12, 2006.

(51) Int. Cl.

| | |
|---|---|
| ***E04F 15/02*** | (2006.01) |
| ***E04F 15/18*** | (2006.01) |
| ***E04B 1/68*** | (2006.01) |
| ***E04C 2/16*** | (2006.01) |
| ***E04C 2/24*** | (2006.01) |

(52) U.S. Cl.

CPC ..... *E04C 2/24* (2013.01); *E04F 15/02* (2013.01); *E04F 15/02016* (2013.01); *E04F 15/02038* (2013.01); *E04F 15/02161* (2013.01); *E04F 15/02172* (2013.01); *E04F 15/02188* (2013.01); *E04F 15/181* (2013.01); *E04F 2201/0115* (2013.01); *E04F 2201/0146* (2013.01); *E04F 2201/0153* (2013.01); *E04F 2201/025* (2013.01); *E04F 2201/026* (2013.01); *E04F 2201/0523* (2013.01); *E04F 2201/0547* (2013.01); *E04F 2201/07* (2013.01); *E04F 2290/042* (2013.01); *Y10T 428/167* (2015.01); *Y10T 428/24777* (2015.01)

(56) References Cited

U.S. PATENT DOCUMENTS

| | | | |
|---|---|---|---|
| 1,018,987 | A | 2/1912 | Philpot et al. |
| 1,361,501 | A | 12/1920 | Schepmoes |
| 1,394,120 | A | 10/1921 | Rockwell |
| 1,723,306 | A | 8/1929 | Sipe |
| 1,743,492 | A | 1/1930 | Sipe |
| 1,787,027 | A | 12/1930 | Wasleff |
| 1,925,070 | A | 8/1933 | Livezey |
| 1,946,646 | A | 2/1934 | Storm |
| 1,946,690 | A | 2/1934 | Haines |
| 2,015,813 | A | 10/1935 | Nielsen |
| 2,088,238 | A | 7/1937 | Greenway |
| 2,089,075 | A | 8/1937 | Siebs |
| 2,142,305 | A | 1/1939 | Davis |
| 2,204,675 | A | 6/1940 | Grunert |
| 2,266,464 | A | 12/1941 | Kraft |
| 2,303,745 | A | 12/1942 | Karreman |
| 2,306,295 | A | 12/1942 | Casto |
| 2,355,834 | A | 8/1944 | Webb |
| 2,497,837 | A | 2/1950 | Nelson |
| 2,740,167 | A | 4/1956 | Rowley |
| 2,758,044 | A | 8/1956 | Terry |
| 2,769,726 | A | 11/1956 | Wetterau et al. |
| 2,818,895 | A | 1/1958 | Zuber |
| 2,872,712 | A | 2/1959 | Brown |
| 2,947,040 | A | 8/1960 | Schultz |
| 3,055,461 | A | 9/1962 | De Ridder |
| 3,082,488 | A | 3/1963 | Nusbaum et al. |
| 3,087,269 | A | 4/1963 | Hudson |
| 3,120,083 | A | 2/1964 | Dahlberg et al. |
| 3,247,638 | A | 4/1966 | Gay et al. |
| 3,259,417 | A | 7/1966 | Chapman |
| 3,310,919 | A | 3/1967 | Bue et al. |
| 3,397,496 | A | 8/1968 | Sohns |
| 3,428,471 | A | 2/1969 | Tuthill et al. |
| 3,436,888 | A | 4/1969 | Ottosson |
| 3,514,393 | A | 5/1970 | Eisby |
| 3,538,665 | A | 11/1970 | Gohner |
| 3,554,850 | A | 1/1971 | Kuhle |
| 3,578,548 | A | 5/1971 | Wesp |
| 3,619,963 | A | 11/1971 | Omholt |
| 3,623,288 | A | 11/1971 | Horowitz |
| 3,650,549 | A | 3/1972 | Pepper |
| 3,657,852 | A | 4/1972 | Worthington et al. |
| 3,694,983 | A | 10/1972 | Couquet |
| 3,723,220 | A | 3/1973 | Scher et al. |
| 3,760,547 | A | 9/1973 | Brenneman |
| 3,837,634 | A | 9/1974 | Cobb |
| 3,857,749 | A | 12/1974 | Yoshida |
| 3,870,591 | A | 3/1975 | Witman et al. |
| 3,879,505 | A | 4/1975 | Boutillier et al. |
| 3,883,258 | A | 5/1975 | Hewson |
| 3,908,725 | A | 9/1975 | Koch |
| 3,924,023 | A | 12/1975 | Boran et al. |
| 3,937,861 | A | 2/1976 | Zuckerman et al. |
| 3,946,529 | A | 3/1976 | Chevaux |
| 3,950,915 | A | 4/1976 | Cole |
| 4,018,957 | A | 4/1977 | Werner et al. |
| 4,023,596 | A | 5/1977 | Tate |
| 4,037,377 | A | 7/1977 | Howell et al. |
| 4,100,710 | A | 7/1978 | Kowallik |
| 4,113,909 | A | 9/1978 | Beasley |
| 4,136,224 | A | 1/1979 | Minami et al. |
| 4,164,389 | A | 8/1979 | Beasley |
| 4,169,688 | A | 10/1979 | Toshio |
| 4,170,859 | A | 10/1979 | Counihan |
| 4,176,210 | A | 11/1979 | Skinner |
| 4,180,615 | A | 12/1979 | Bettoli |
| 4,208,468 | A | 6/1980 | Cunningham et al. |
| 4,226,064 | A | 10/1980 | Kraayenhof |
| 4,242,390 | A | 12/1980 | Nemeth |
| 4,244,151 | A | 1/1981 | Seem |
| 4,296,017 | A | 10/1981 | Weissgerber et al. |
| 4,296,582 | A | 10/1981 | Simpson et al. |
| 4,299,070 | A | 11/1981 | Oltmanns et al. |
| 4,312,686 | A | 1/1982 | Smith et al. |
| 4,315,050 | A | 2/1982 | Rourke |
| 4,315,724 | A | 2/1982 | Taoka et al. |
| 4,328,152 | A | 5/1982 | Tsigdinos et al. |
| 4,329,307 | A | 5/1982 | Westcott et al. |
| 4,337,321 | A | 6/1982 | Allada |
| 4,393,187 | A | 7/1983 | Boba et al. |
| 4,396,566 | A | 8/1983 | Brinkmann et al. |
| 4,426,820 | A | 1/1984 | Terbrack et al. |
| 4,439,187 | A | 3/1984 | Butterfield |
| 4,449,346 | A | 5/1984 | Tremblay |
| 4,454,699 | A | 6/1984 | Strobl |
| 4,456,643 | A | 6/1984 | Colyer |
| 4,457,120 | A | 7/1984 | Takata |
| 4,489,115 | A | 12/1984 | Layman et al. |
| 4,512,131 | A | 4/1985 | Laramore |
| 4,526,418 | A | 7/1985 | Martin |
| 4,571,353 | A | 2/1986 | Gable |
| 4,574,099 | A | 3/1986 | Nixon |
| 4,599,264 | A | 7/1986 | Kaufmann et al. |
| 4,599,841 | A | 7/1986 | Haid |
| 4,610,900 | A | 9/1986 | Nishibori |
| 4,644,720 | A | 2/1987 | Schneider |
| 4,689,259 | A | 8/1987 | Miller, Jr. et al. |
| 4,698,258 | A | 10/1987 | Harkins |
| 4,707,393 | A | 11/1987 | Vetter |
| 4,710,415 | A | 12/1987 | Slosberg et al. |
| 4,724,187 | A | 2/1988 | Ungar et al. |
| 4,759,164 | A | 7/1988 | Abendroth et al. |
| 4,769,963 | A | 9/1988 | Meyerson |
| 4,788,088 | A | 11/1988 | Kohl |
| 4,801,495 | A | 1/1989 | Van Der Hoeven |
| 4,807,412 | A | 2/1989 | Frederiksen |
| 4,849,768 | A | 7/1989 | Graham |
| 4,865,807 | A | 9/1989 | Petershofer et al. |

(56) References Cited

U.S. PATENT DOCUMENTS 4,935,286 A 6/1990 Witman
4,940,503 A 7/1990 Lindgren et al.
4,944,514 A 7/1990 Suiter
4,947,595 A 8/1990 Douds et al.
4,976,221 A 12/1990 Yetter
5,007,222 A 4/1991 Raymond
5,022,200 A 6/1991 Wilson et al.
5,050,362 A 9/1991 Tal et al.
5,050,653 A 9/1991 Brown
5,052,158 A 10/1991 D'Luzansky
5,066,531 A 11/1991 Legg et al.
5,076,034 A 12/1991 Bandy
5,102,716 A 4/1992 Balmer et al.
5,103,614 A 4/1992 Kawaguchi et al.
5,112,671 A 5/1992 Diamond et al.
5,113,632 A 5/1992 Hanson
5,122,212 A 6/1992 Ferguson et al.
5,134,026 A 7/1992 Melcher
5,158,986 A 10/1992 Cha et al.
5,162,141 A 11/1992 Davey et al.
5,183,438 A 2/1993 Blom
5,185,193 A 2/1993 Phenicie et al.
5,187,501 A 2/1993 Lewicki, Jr. et al.
5,229,217 A 7/1993 Holzer
5,277,852 A 1/1994 Spydevold
5,295,341 A 3/1994 Kajiwara
5,303,526 A 4/1994 Niese
5,322,335 A 6/1994 Niemi
5,333,429 A 8/1994 Cretti
5,349,796 A 9/1994 Meyerson
5,367,844 A 11/1994 Diedrich
5,425,986 A 6/1995 Guyette
5,433,806 A 7/1995 Pasquali et al.
5,458,953 A 10/1995 Wang et al.
5,475,952 A 12/1995 O'Connor
5,480,602 A 1/1996 Nagaich
5,494,707 A 2/1996 Wang et al.
5,502,939 A 4/1996 Zadok
5,503,788 A 4/1996 Lazareck et al.
5,516,472 A 5/1996 Laver
5,547,741 A 8/1996 Wilson
5,553,427 A 9/1996 Andres
5,595,625 A 1/1997 Fishel et al.
5,613,339 A 3/1997 Pollock
5,618,602 A 4/1997 Nelson
5,627,231 A 5/1997 Shalov et al.
5,642,592 A 7/1997 Andres
5,643,677 A 7/1997 Feifer et al.
5,647,184 A 7/1997 Davis
5,653,099 A 8/1997 Mackenzie
5,660,016 A 8/1997 Erwin et al.
5,662,977 A 9/1997 Spain et al.
5,670,237 A 9/1997 Shultz et al.
5,671,575 A 9/1997 Wu
5,681,652 A 10/1997 Cope
5,694,730 A 12/1997 Del Rincon et al.
5,706,621 A 1/1998 Pervan
5,713,165 A 2/1998 Erwin
5,719,227 A 2/1998 Rosenberry et al.
5,724,909 A 3/1998 Pitman et al.
5,728,476 A 3/1998 Harwood
5,747,133 A 5/1998 Vinod et al.
5,755,068 A 5/1998 Ormiston
5,758,466 A 6/1998 Tucker
5,777,014 A 7/1998 Hopper et al.
5,780,147 A 7/1998 Sugahara et al.
5,791,113 A 8/1998 Glowa et al.
5,791,114 A 8/1998 Mandel
5,797,237 A 8/1998 Finkell, Jr.
5,824,415 A 10/1998 Kanki et al.
5,830,937 A 11/1998 Shalov et al.
5,833,386 A 11/1998 Rosan et al.
5,834,081 A 11/1998 Fanti
5,836,128 A 11/1998 Groh et al.
5,856,389 A 1/1999 Kostrzewski et al.
5,858,160 A 1/1999 Piacente
5,863,632 A 1/1999 Bisker
5,869,138 A 2/1999 Nishibori
D406,360 S 3/1999 Finkell, Jr.
5,900,099 A 5/1999 Sweet
5,901,510 A 5/1999 Ellingson
5,965,232 A 10/1999 Vinod
5,968,630 A 10/1999 Foster
5,985,429 A 11/1999 Plummer et al.
5,989,668 A 11/1999 Nelson et al.
6,004,417 A 12/1999 Roesch et al.
6,006,486 A 12/1999 Moriau
6,023,907 A 2/2000 Pervan
6,027,599 A 2/2000 Wang
6,029,416 A 2/2000 Anderson
6,093,473 A 7/2000 Min
6,101,778 A 8/2000 Martensson
6,103,044 A 8/2000 Harwood et al.
6,139,945 A 10/2000 Krejchi et al.
6,173,548 B1 1/2001 Hamar et al.
6,189,282 B1 2/2001 Vanderwerf
6,228,463 B1 5/2001 Chen et al.
6,233,899 B1 5/2001 Mellert et al.
6,250,040 B1 6/2001 Green
6,260,326 B1 7/2001 Muller-Hartburg
6,314,701 B1 11/2001 Meyerson
6,324,809 B1 12/2001 Nelson
6,332,733 B1 12/2001 Hamberger et al.
6,333,076 B1 12/2001 Sigel et al.
6,345,481 B1 2/2002 Nelson
6,348,268 B1 2/2002 Donnelly et al.
6,363,677 B1 4/2002 Chen
6,397,547 B1 6/2002 Martensson
6,421,970 B1 7/2002 Mårtensson et al.
6,428,871 B1 8/2002 Cozzolino
6,436,159 B1 8/2002 Safta et al.
6,438,919 B1 8/2002 Knauseder
6,449,918 B1 9/2002 Nelson
6,455,127 B1 9/2002 Valtanen
6,460,306 B1 10/2002 Nelson
6,505,452 B1 1/2003 Hannig
6,536,178 B1 3/2003 Palsson et al.
6,546,691 B2 4/2003 Leopolder
6,558,070 B1 5/2003 Valtanen
6,591,568 B1 7/2003 Palsson et al.
6,617,009 B1 9/2003 Chen et al.
6,641,926 B1 11/2003 Malina
6,647,690 B1 11/2003 Martensson
6,671,968 B2 1/2004 Shannon
6,672,030 B2 1/2004 Schulte
6,675,545 B2 1/2004 Chen et al.
6,695,944 B2 2/2004 Courtney
6,711,869 B2 3/2004 Tychsen
6,715,253 B2 4/2004 Pervan
6,729,091 B1 5/2004 Martensson
6,753,066 B2 6/2004 Eby et al.
6,761,008 B2 7/2004 Chen et al.
6,766,622 B1 7/2004 Thiers
6,769,218 B2 8/2004 Pervan
6,769,219 B2 8/2004 Schwitte et al.
6,786,019 B2 9/2004 Thiers
6,804,926 B1 10/2004 Eisermann
6,835,421 B1 12/2004 Dohring
6,851,237 B2 2/2005 Niese et al.
6,854,235 B2 2/2005 Martensson
6,862,857 B2 3/2005 Tychsen
6,874,292 B2 4/2005 Moriau
6,880,305 B2 4/2005 Pervan et al.
6,880,307 B2 4/2005 Schwitte
6,895,881 B1 5/2005 Whitaker
6,898,911 B2 5/2005 Kornfalt et al.
6,898,913 B2 5/2005 Pervan
6,918,220 B2 7/2005 Pervan
6,920,732 B2 7/2005 Mårtensson
6,922,964 B2 8/2005 Pervan
6,922,965 B2 8/2005 Rosenthal et al.
6,933,043 B1 8/2005 Son et al.
6,955,020 B2 10/2005 Moriau et al.
6,966,963 B2 11/2005 O'Connor

(56) References Cited

U.S. PATENT DOCUMENTS 6,986,934 B2 1/2006 Chen et al.
7,003,364 B1 2/2006 Hansson et al.
7,051,486 B2 5/2006 Pervan
7,086,205 B2 8/2006 Pervan
7,090,430 B1 8/2006 Fletcher
D528,671 S 9/2006 Grafenauer
7,121,058 B2 10/2006 Palsson et al.
7,127,860 B2 10/2006 Pervan et al.
7,137,229 B2 * 11/2006 Pervan ..... B32B 38/105 52/390
7,155,871 B1 1/2007 Stone
7,168,221 B2 1/2007 Hunter, Jr.
7,169,460 B1 1/2007 Chen et al.
7,171,791 B2 2/2007 Pervan
7,211,310 B2 5/2007 Chen et al.
7,261,947 B2 8/2007 Reichwein
7,275,350 B2 10/2007 Pervan et al.
7,328,536 B2 2/2008 Moriau et al.
7,337,588 B1 3/2008 Moebus
7,356,971 B2 4/2008 Pervan
7,386,963 B2 6/2008 Pervan
7,398,625 B2 7/2008 Pervan
7,419,717 B2 9/2008 Chen et al.
7,442,423 B2 10/2008 Miller
7,454,875 B2 11/2008 Pervan et al.
7,516,588 B2 4/2009 Pervan
7,543,418 B2 6/2009 Weitzer
7,544,423 B2 6/2009 Horton
7,568,322 B2 8/2009 Pervan et al.
7,584,583 B2 * 9/2009 Bergelin ..... E04F 15/02038 52/177
7,603,826 B1 10/2009 Moebus
7,739,849 B2 6/2010 Pervan
7,763,345 B2 7/2010 Chen et al.
7,770,350 B2 8/2010 Moriau et al.
7,779,597 B2 8/2010 Thiers et al.
7,802,415 B2 9/2010 Pervan
7,856,784 B2 12/2010 Martensson
7,856,789 B2 12/2010 Eisermann
7,861,482 B2 1/2011 Pervan
7,866,115 B2 * 1/2011 Pervan ..... B44C 1/222 52/749.11
7,877,956 B2 2/2011 Martensson
7,886,497 B2 2/2011 Pervan et al.
7,896,571 B1 3/2011 Hannig et al.
7,926,234 B2 4/2011 Pervan
7,930,862 B2 4/2011 Bergelin et al.
7,980,043 B2 7/2011 Moebus
8,021,741 B2 9/2011 Chen et al.
8,028,486 B2 10/2011 Pervan
8,099,919 B2 1/2012 Garcia
8,112,891 B2 * 2/2012 Pervan ..... B32B 5/26 29/897
8,182,928 B2 5/2012 Horton
8,234,829 B2 8/2012 Thiers et al.
8,245,478 B2 8/2012 Bergelin et al.
8,293,058 B2 10/2012 Pervan et al.
8,356,452 B2 1/2013 Thiers et al.
8,365,499 B2 2/2013 Nilsson et al.
8,431,054 B2 4/2013 Pervan
8,480,841 B2 7/2013 Pervan et al.
8,484,920 B2 7/2013 Thiers
8,490,361 B2 7/2013 Curry et al.
8,511,031 B2 8/2013 Bergelin et al.
8,584,423 B2 11/2013 Pervan et al.
8,613,826 B2 12/2013 Pervan et al.
8,658,274 B2 2/2014 Chen et al.
8,683,698 B2 4/2014 Pervan et al.
8,756,899 B2 6/2014 Nilsson et al.
8,800,150 B2 8/2014 Pervan
8,833,028 B2 9/2014 Whispell et al.
8,834,992 B2 9/2014 Chen et al.
8,857,127 B2 * 10/2014 Windmoller ..... E04F 15/105 52/309.16
8,875,465 B2 11/2014 Martensson
9,222,267 B2 12/2015 Bergelin et al.
9,249,581 B2 2/2016 Nilsson et al.
9,296,191 B2 3/2016 Pervan et al.
9,314,936 B2 4/2016 Pervan
9,315,994 B2 * 4/2016 Chen ..... B41J 3/407
9,410,328 B2 8/2016 Pervan
9,695,601 B2 7/2017 Whispell et al.
9,714,515 B2 7/2017 Pervan
9,765,530 B2 9/2017 Bergelin et al.
9,951,526 B2 4/2018 Boo et al.
10,047,527 B2 8/2018 Nilsson et al.
10,059,084 B2 8/2018 Lundblad et al.
10,137,659 B2 11/2018 Pervan
10,287,777 B2 5/2019 Boo et al.
10,301,830 B2 5/2019 Boo
10,316,526 B2 6/2019 Kell
10,344,379 B2 7/2019 Pervan
10,407,919 B2 9/2019 Boo
10,450,760 B2 10/2019 Bergelin et al.
10,486,399 B2 11/2019 Chen et al.
10,493,731 B2 12/2019 Lundblad et al.
10,526,793 B2 1/2020 Nilsson et al.
10,704,269 B2 7/2020 Whispell et al.
10,780,676 B2 9/2020 Lundblad et al.
10,787,822 B2 9/2020 Dossche et al.
10,808,410 B2 10/2020 Boo et al.
10,837,181 B2 11/2020 Josefsson et al.
10,844,612 B2 11/2020 Boo
10,851,549 B2 12/2020 Boo
10,865,571 B2 12/2020 Kell
10,975,580 B2 4/2021 Pervan et al.
10,982,449 B2 4/2021 Kell
11,066,836 B2 7/2021 Bergelin et al.
11,149,442 B2 * 10/2021 Courey ..... B32B 9/002
11,306,486 B2 4/2022 Nilsson et al.
2001/0021431 A1 9/2001 Chen
2001/0036557 A1 11/2001 Ingrim et al.
2002/0007608 A1 1/2002 Pervan
2002/0007609 A1 1/2002 Pervan
2002/0023702 A1 2/2002 Kettler
2002/0025446 A1 2/2002 Chen et al.
2002/0031646 A1 3/2002 Chen
2002/0046433 A1 4/2002 Sellman et al.
2002/0046527 A1 4/2002 Nelson
2002/0056245 A1 5/2002 Thiers
2002/0083673 A1 7/2002 Kettler et al.
2002/0092263 A1 7/2002 Schulte
2002/0095894 A1 7/2002 Pervan
2002/0100231 A1 8/2002 Miller et al.
2002/0112429 A1 8/2002 Niese et al.
2002/0112433 A1 8/2002 Pervan
2002/0142135 A1 10/2002 Chen et al.
2002/0170257 A1 11/2002 McLain et al.
2002/0170258 A1 11/2002 Schwitte et al.
2002/0178674 A1 12/2002 Pervan
2002/0178681 A1 12/2002 Zancai
2002/0189183 A1 12/2002 Ricciardelli
2003/0009971 A1 1/2003 Palmberg
2003/0019174 A1 1/2003 Bolduc
2003/0024199 A1 2/2003 Pervan
2003/0024200 A1 2/2003 Moriau et al.
2003/0033777 A1 2/2003 Thiers et al.
2003/0101674 A1 6/2003 Pervan et al.
2003/0101681 A1 6/2003 Tychsen
2003/0154676 A1 8/2003 Schwartz
2003/0196397 A1 10/2003 Niese et al.
2003/0196405 A1 10/2003 Pervan
2004/0003888 A1 1/2004 Mott et al.
2004/0016196 A1 1/2004 Pervan
2004/0031227 A1 2/2004 Knauseder
2004/0035078 A1 2/2004 Pervan
2004/0068954 A1 4/2004 Martensson
2004/0107659 A1 6/2004 Glockl
2004/0139678 A1 7/2004 Pervan
2004/0177584 A1 * 9/2004 Pervan ..... B32B 21/10 52/592.1
2004/0182036 A1 9/2004 Sjöberg et al.
2004/0200154 A1 10/2004 Hunter

(56) References Cited

U.S. PATENT DOCUMENTS

2004/0206036 A1 10/2004 Pervan
2004/0211144 A1 10/2004 Stanchfield
2004/0248489 A1 12/2004 Hutchison et al.
2004/0255538 A1 12/2004 Ruhdorfer
2004/0255541 A1 12/2004 Thiers et al.
2005/0003160 A1 1/2005 Chen et al.
2005/0016099 A1 1/2005 Thiers
2005/0025934 A1 2/2005 Thiers
2005/0055943 A1 3/2005 Pervan
2005/0108970 A1 5/2005 Liu
2005/0136234 A1 6/2005 Hak
2005/0138881 A1* 6/2005 Pervan ..... E04F 15/02 52/581
2005/0166502 A1 8/2005 Pervan
2005/0166514 A1* 8/2005 Pervan ..... E04F 15/02038 52/578
2005/0166516 A1 8/2005 Pervan
2005/0021081 A1 9/2005 Pervan
2005/0193677 A1 9/2005 Vogel
2005/0208255 A1 9/2005 Pervan
2005/0268570 A2 12/2005 Pervan
2005/0281986 A1 12/2005 Nam
2006/0024465 A1 2/2006 Briere
2006/0032168 A1 2/2006 Thiers
2006/0032175 A1 2/2006 Chen et al.
2006/0048474 A1 3/2006 Pervan et al.
2006/0075713 A1 4/2006 Pervan et al.
2006/0099386 A1* 5/2006 Smith ..... B44C 5/043 428/192
2006/0101769 A1 5/2006 Pervan et al.
2006/0130416 A1 6/2006 Mohr
2006/0144004 A1 7/2006 Nollet et al.
2006/0156666 A1 7/2006 Caufield
2006/0174578 A1 8/2006 Konstanczak
2006/0196139 A1 9/2006 Pervan
2006/0283127 A1 12/2006 Pervan
2007/0011981 A1 1/2007 Eiserman
2007/0028547 A1 2/2007 Grafenauer et al.
2007/0130872 A1 6/2007 Goodwin
2007/0166516 A1 7/2007 Kim et al.
2007/0175143 A1 8/2007 Pervan et al.
2007/0175144 A1 8/2007 Hakansson
2007/0175148 A1* 8/2007 Bergelin ..... E04C 2/24 52/480
2007/0175156 A1 8/2007 Pervan et al.
2007/0196624 A1 8/2007 Chen et al.
2008/0000179 A1* 1/2008 Pervan ..... B23C 3/305 52/390
2008/0000180 A1 1/2008 Pervan
2008/0000182 A1 1/2008 Pervan
2008/0000183 A1 1/2008 Bergelin et al.
2008/0000186 A1 1/2008 Pervan
2008/0000187 A1 1/2008 Pervan
2008/0000188 A1 1/2008 Pervan
2008/0000189 A1 1/2008 Pervan et al.
2008/0000194 A1 1/2008 Pervan
2008/0000417 A1 1/2008 Pervan et al.
2008/0005989 A1 1/2008 Pervan et al.
2008/0005992 A1 1/2008 Pervan
2008/0005997 A1 1/2008 Pervan
2008/0005998 A1 1/2008 Pervan
2008/0005999 A1 1/2008 Pervan
2008/0008871 A1 1/2008 Pervan
2008/0010931 A1 1/2008 Pervan
2008/0010937 A1 1/2008 Pervan
2008/0028707 A1 2/2008 Pervan
2008/0028713 A1 2/2008 Pervan
2008/0029490 A1 2/2008 Martin et al.
2008/0034701 A1 2/2008 Pervan
2008/0034708 A1 2/2008 Pervan
2008/0041007 A1 2/2008 Pervan et al.
2008/0041008 A1 2/2008 Pervan
2008/0060308 A1 3/2008 Pervan
2008/0063844 A1 3/2008 Chen et al.
2008/0066415 A1 3/2008 Pervan et al.
2008/0104921 A1 5/2008 Pervan et al.
2008/0110125 A1 5/2008 Pervan
2008/0134607 A1 6/2008 Pervan et al.
2008/0134613 A1 6/2008 Pervan et al.
2008/0134614 A1 6/2008 Pervan et al.
2008/0138560 A1 6/2008 Windmoller
2008/0168737 A1 7/2008 Pervan
2008/0172971 A1 7/2008 Pervan
2008/0236088 A1 10/2008 Hannig
2008/0241440 A1 10/2008 Bauer
2008/0256890 A1 10/2008 Pervan
2008/0261019 A1 10/2008 Shen
2008/0263975 A1* 10/2008 Mead ..... B32B 29/06 428/192
2008/0311355 A1 12/2008 Chen et al.
2009/0000232 A1 1/2009 Thiers
2009/0019806 A1 1/2009 Muehlebach
2009/0041987 A1 2/2009 Schitter
2009/0049787 A1 2/2009 Hannig
2009/0133353 A1 5/2009 Pervan et al.
2009/0151290 A1 6/2009 Liu
2009/0155612 A1 6/2009 Pervan et al.
2009/0193748 A1 8/2009 Boo et al.
2009/0249733 A1 10/2009 Moebus
2010/0242398 A1 9/2010 Cullen
2010/0260962 A1 10/2010 Chen et al.
2010/0300030 A1 12/2010 Pervan et al.
2010/0310893 A1 12/2010 Derbyshire et al.
2010/0319291 A1 12/2010 Pervan et al.
2011/0030303 A1 2/2011 Pervan et al.
2011/0041996 A1 2/2011 Pervan
2011/0056167 A1 3/2011 Nilsson et al.
2011/0131901 A1 6/2011 Pervan et al.
2011/0154665 A1 6/2011 Pervan
2011/0154763 A1 6/2011 Bergelin et al.
2011/0167744 A1 7/2011 Whispell et al.
2011/0167750 A1 7/2011 Pervan
2011/0247748 A1 10/2011 Pervan et al.
2012/0003439 A1 1/2012 Chen et al.
2012/0040149 A1 2/2012 Chen et al.
2012/0096792 A1 4/2012 Thiers
2012/0124932 A1 5/2012 Schulte et al.
2012/0137617 A1 6/2012 Pervan
2012/0174519 A1 7/2012 Schulte
2012/0216472 A1 8/2012 Martensson
2012/0255156 A1 10/2012 Vermeulen
2012/0266555 A1 10/2012 Cappelle
2012/0279154 A1 11/2012 Bergelin et al.
2012/0288642 A1 11/2012 Smith
2013/0014463 A1 1/2013 Pervan
2013/0014890 A1 1/2013 Pervan et al.
2013/0042565 A1 2/2013 Pervan et al.
2013/0047536 A1 2/2013 Pervan
2013/0104486 A1* 5/2013 Windmoller ..... E04F 15/107 29/428
2013/0111758 A1 5/2013 Nilsson et al.
2013/0269863 A1 10/2013 Pervan et al.
2013/0298487 A1 11/2013 Bergelin et al.
2013/0305649 A1 11/2013 Thiers
2014/0020325 A1 1/2014 Pervan
2014/0033635 A1 2/2014 Pervan et al.
2014/0115994 A1 5/2014 Pervan
2014/0166201 A1 6/2014 Pervan
2014/0237924 A1 8/2014 Nilsson et al.
2014/0283466 A1 9/2014 Boo
2014/0318061 A1 10/2014 Pervan
2014/0352248 A1 12/2014 Whispell et al.
2014/0356594 A1 12/2014 Chen et al.
2015/0075105 A1 3/2015 Engstrom
2015/0225964 A1 8/2015 Chen et al.
2015/0375471 A1* 12/2015 Song ..... E04F 13/0885 156/304.3
2016/0016390 A1 1/2016 Lundblad et al.
2016/0016391 A1 1/2016 Lundblad et al.
2016/0052245 A1 2/2016 Chen et al.
2016/0069089 A1 3/2016 Bergelin et al.
2016/0108624 A1 4/2016 Nilsson et al.
2016/0186318 A1 6/2016 Pervan et al.

(56) References Cited

U.S. PATENT DOCUMENTS

| | | | |
|---|---|---|---|
| 2016/0194883 | A1 | 7/2016 | Pervan |
| 2016/0194885 | A1 | 7/2016 | Whispell et al. |
| 2016/0201324 | A1 | 7/2016 | Håkansson et al. |
| 2016/0265234 | A1 | 9/2016 | Pervan |
| 2017/0037642 | A1 | 2/2017 | Boo |
| 2017/0037645 | A1 | 2/2017 | Pervan |
| 2017/0175400 | A1 | 6/2017 | Joseffson et al. |
| 2017/0241136 | A1 | 8/2017 | Kell |
| 2017/0350140 | A1 | 12/2017 | Bergelin et al. |
| 2018/0094441 | A1 | 4/2018 | Boo |
| 2018/0313093 | A1 | 11/2018 | Nilsson et al. |
| 2019/0091977 | A1 | 3/2019 | Lundblad et al. |
| 2019/0211569 | A1 | 7/2019 | Boo et al. |
| 2019/0249444 | A1 | 8/2019 | Kell |
| 2019/0277041 | A1 | 9/2019 | Pervan et al. |
| 2020/0056379 | A1 | 2/2020 | Boo |
| 2020/0063441 | A1 | 2/2020 | Boo |
| 2020/0180282 | A1 | 6/2020 | Lundblad et al. |
| 2020/0208409 | A1 | 7/2020 | Kell |
| 2020/0248462 | A1 | 8/2020 | Bergelin et al. |
| 2020/0362567 | A1 | 11/2020 | Nilsson et al. |
| 2020/0385999 | A1 | 12/2020 | Dossche et al. |
| 2020/0407981 | A1 | 12/2020 | Boo et al. |
| 2021/0053322 | A1 | 2/2021 | Lundblad et al. |
| 2021/0115680 | A1 | 4/2021 | Whispell et al. |
| 2021/0207385 | A1 | 7/2021 | Boo |
| 2021/0214953 | A1 | 7/2021 | Kell |
| 2021/0230881 | A1 | 7/2021 | Boo |

FOREIGN PATENT DOCUMENTS

| | | | | |
|---|---|---|---|---|
| CN | 2106197 | U | 6/1992 | |
| CN | 2124276 | U | 12/1992 | |
| CN | 2272915 | Y | 1/1998 | |
| CN | 2301491 | Y | 12/1998 | |
| CN | 1482166 | A | 3/2004 | |
| CN | 1656291 | A | 8/2005 | |
| CN | 2765969 | Y | 3/2006 | |
| DE | 1 534 802 | | 4/1970 | |
| DE | 28 24 656 | A1 | 1/1979 | |
| DE | 134 967 | | 4/1979 | |
| DE | 28 32 817 | A1 | 2/1980 | |
| DE | 31 50 352 | A1 | 10/1982 | |
| DE | 31 35 716 | A1 | 6/1983 | |
| DE | 33 43 601 | A1 | 12/1983 | |
| DE | 35 38 538 | A1 | 5/1987 | |
| DE | 39 04 686 | C1 | 8/1989 | |
| DE | 39 32 980 | A1 | 11/1991 | |
| DE | 40 20 682 | A1 | 1/1992 | |
| DE | 94 01 365 | U1 | 3/1994 | |
| DE | 42 42 530 | A1 | 6/1994 | |
| DE | 295 17 995 | U1 | 3/1996 | |
| DE | 299 08 733 | U1 | 8/1999 | |
| DE | 298 23 681 | U1 | 11/1999 | |
| DE | 200 02 744 | U1 | 9/2000 | |
| DE | 200 08 708 | U1 | 9/2000 | |
| DE | 299 14 604 | U1 | 1/2001 | |
| DE | 200 18 817 | U1 | 2/2001 | |
| DE | 199 44 399 | A1 | 4/2001 | |
| DE | 100 01 248 | A1 | 7/2001 | |
| DE | 100 32 204 | C1 | 7/2001 | |
| DE | 100 06 748 | A1 | 8/2001 | |
| DE | 202 06 460 | U1 | 7/2002 | |
| DE | 202 07 844 | U | 8/2002 | |
| DE | 202 14 532 | U1 | 2/2004 | |
| DE | 103 16 886 | A1 | 10/2004 | |
| DE | 20 2004 014 160 | U1 | 12/2004 | |
| DE | 10 2004 011 531 | B3 | 11/2005 | |
| DE | 198 54 475 | B4 | 6/2006 | |
| DE | 10 2005 023 661 | A1 | 11/2006 | |
| EP | 0 040 443 | A2 | 11/1981 | |
| EP | 0 046 526 | A2 | 3/1982 | |
| EP | 0 085 196 | A1 | 8/1983 | |
| EP | 0 548 767 | A1 | 6/1993 | |
| EP | 0 562 402 | A1 | 9/1993 | |
| EP | 0 592 013 | A2 | 4/1994 | |
| EP | 0 665 347 | A1 | 8/1995 | |
| EP | 0 890 373 | A1 | 1/1999 | |
| EP | 0 893 473 | A1 | 1/1999 | |
| EP | 0 903 451 | A2 | 3/1999 | |
| EP | 0 903 451 | A3 | 8/1999 | |
| EP | 1 024 234 | A2 | 8/2000 | |
| EP | 0 843 763 | B1 | 10/2000 | |
| EP | 1 061 201 | A2 | 12/2000 | |
| EP | 1 097 804 | A1 | 5/2001 | |
| EP | 1 108 529 | A2 | 6/2001 | |
| EP | 1 045 083 | B1 | 10/2002 | |
| EP | 1 262 607 | A1 | 12/2002 | |
| EP | 1 262 609 | A1 | 12/2002 | |
| EP | 1 357 239 | A2 | 10/2003 | |
| EP | 1 362 947 | | 11/2003 | |
| EP | 0 890 373 | B1 | 2/2004 | |
| EP | 1 631 618 | | 3/2006 | |
| EP | 2586929 | A1 * | 5/2013 | ..... B44C 5/04 |
| FR | 1 293 043 | A | 4/1962 | |
| FR | 2 278 876 | A1 | 2/1976 | |
| FR | 2 445 875 | A1 | 8/1980 | |
| FR | 2 498 666 | A1 | 7/1982 | |
| FR | 2 557 905 | | 7/1985 | |
| FR | 2 810 060 | A1 | 12/2001 | |
| GB | 25 180 | | 7/1907 | |
| GB | 484 750 | | 5/1938 | |
| GB | 518 239 | A | 2/1940 | |
| GB | 875 327 | | 8/1961 | |
| GB | 900 958 | | 7/1962 | |
| GB | 1 189 485 | | 4/1970 | |
| GB | 1 308 011 | | 2/1973 | |
| GB | 1 430 423 | A | 3/1976 | |
| GB | 1 520 964 | A | 8/1978 | |
| GB | 2 020 998 | A | 11/1979 | |
| GB | 2 029 393 | A | 3/1980 | |
| GB | 2 095 814 | A | 10/1982 | |
| GB | 2117813 | A | 10/1983 | |
| GB | 2 145 371 | A | 3/1985 | |
| GB | 2 147 856 | A | 5/1985 | |
| GB | 2 243 381 | A | 10/1991 | |
| GB | 2 256 023 | A | 11/1992 | |
| GB | 2 264 453 | | 9/1993 | |
| GB | 2 338 435 | A | 12/1999 | |
| JP | S56-104936 | U | 1/1981 | |
| JP | S56-131752 | A | 10/1981 | |
| JP | S57-119056 | | 7/1982 | |
| JP | S57-157636 | U | 10/1982 | |
| JP | S60-255843 | A | 12/1985 | |
| JP | S62-127225 | A | 6/1987 | |
| JP | H01-178659 | A | 7/1989 | |
| JP | H01-202403 | A | 8/1989 | |
| JP | H01-33702 | Y2 | 10/1989 | |
| JP | H03-169967 | A | 7/1991 | |
| JP | H05-169534 | A | 7/1993 | |
| JP | H05-96282 | U | 12/1993 | |
| JP | H05-318674 | A | 12/1993 | |
| JP | H06-064108 | A | 3/1994 | |
| JP | H06-39840 | B2 | 5/1994 | |
| JP | H06-315944 | A | 11/1994 | |
| JP | H07-26467 | U | 5/1995 | |
| JP | H07-180333 | A | 7/1995 | |
| JP | H08-086080 | A | 4/1996 | |
| JP | H08-109734 | A | 4/1996 | |
| JP | H09-053319 | A | 2/1997 | |
| JP | H09-254697 | A | 9/1997 | |
| JP | H10-002096 | A | 1/1998 | |
| JP | H10-102743 | A | 4/1998 | |
| JP | H10-219975 | A | 8/1998 | |
| JP | H11-131771 | A | 5/1999 | |
| JP | 2002-011708 | A | 1/2002 | |
| KR | 1996-0005785 | | 7/1996 | |
| KR | 2007-0000322 | A | 1/2007 | |
| RU | 2081135 | C1 | 6/1997 | |
| SE | 506 254 | C2 | 11/1997 | |
| SE | 0103130 | A | 3/2003 | |
| WO | WO 82/00021 | A1 | 1/1982 | |
| WO | WO 88/01934 | A1 | 3/1988 | |
| WO | WO 93/13169 | A1 | 7/1993 | |

(56) References Cited

FOREIGN PATENT DOCUMENTS

| | | | |
|---|---|---|---|
| WO | WO 94/01628 | A2 | 1/1994 |
| WO | WO 94/17996 | A1 | 8/1994 |
| WO | WO 94/21721 | A1 | 9/1994 |
| WO | WO 94/26999 | A1 | 11/1994 |
| WO | WO 95/11333 | A1 | 4/1995 |
| WO | WO 95/17568 | A1 | 6/1995 |
| WO | WO 96/04441 | A1 | 2/1996 |
| WO | WO 96/06248 | A1 | 2/1996 |
| WO | WO 96/07801 | A1 | 3/1996 |
| WO | WO 97/10396 | A1 | 3/1997 |
| WO | WO 97/18949 | A1 | 5/1997 |
| WO | WO 97/21011 | A2 | 6/1997 |
| WO | WO 97/47834 | A1 | 12/1997 |
| WO | WO 98/24995 | A1 | 6/1998 |
| WO | WO 98/38401 | A1 | 9/1998 |
| WO | WO 98/44187 | A1 | 10/1998 |
| WO | WO 99/17930 | A1 | 4/1999 |
| WO | WO 99/39042 | A1 | 8/1999 |
| WO | WO 99/58254 | A1 | 11/1999 |
| WO | WO 99/66151 | A1 | 12/1999 |
| WO | WO 99/66152 | A1 | 12/1999 |
| WO | WO 00/15919 | A1 | 3/2000 |
| WO | WO 00/17467 | A1 | 3/2000 |
| WO | WO 00/20705 | A1 | 4/2000 |
| WO | WO 00/66856 | A1 | 11/2000 |
| WO | WO 01/00406 | A1 | 1/2001 |
| WO | WO 01/02669 | A1 | 1/2001 |
| WO | WO 01/02670 | A1 | 1/2001 |
| WO | WO 01/02672 | A1 | 1/2001 |
| WO | WO 01/45915 | A1 | 6/2001 |
| WO | WO 01/47717 | A1 | 7/2001 |
| WO | WO 01/47726 | A1 | 7/2001 |
| WO | WO 01/48332 | A1 | 7/2001 |
| WO | WO 01/48333 | A1 | 7/2001 |
| WO | WO 01/51732 | A1 | 7/2001 |
| WO | WO 01/51733 | A1 | 7/2001 |
| WO | WO 01/53628 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/88306 | A1 | 11/2001 |
| WO | WO 02/055809 | A1 | 7/2002 |
| WO | WO 02/055810 | A1 | 7/2002 |
| WO | WO 02/060691 | A1 | 8/2002 |
| WO | WO 02/092342 | A1 | 11/2002 |
| WO | WO 03/012224 | A1 | 2/2003 |
| WO | WO 03/025307 | A1 | 3/2003 |
| WO | WO 03/078761 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/005648 | A1 | 1/2004 |
| WO | WO 2004/016877 | A1 | 2/2004 |
| WO | WO 2004/053257 | A1 | 6/2004 |
| WO | WO 2004/085765 | A1 | 10/2004 |
| WO | WO 2004/053257 | A8 | 12/2004 |
| WO | WO 2005/059269 | A1 | 6/2005 |
| WO | WO 2005/068747 | A1 | 7/2005 |
| WO | WO 2006/043893 | A1 | 4/2006 |
| WO | WO 2006/084513 | A1 | 8/2006 |
| WO | WO 2006/133690 | A1 | 12/2006 |
| WO | WO 2007/015669 | A2 | 2/2007 |
| WO | WO 2007/081267 | A1 | 7/2007 |
| WO | WO 2008/004960 | A2 | 1/2008 |
| WO | WO 2008/008824 | A1 | 1/2008 |
| WO | WO-2021204810 | A1 * | 10/2021 |

OTHER PUBLICATIONS

Extended European Search Report dated Dec. 6, 2016 in EP 07701093.2, European Patent Office, Munich, DE, 8 pages.

Extended European Search Report dated Aug. 28, 2018 in EP 18175880.6, European Patent Office, Munich, DE, 9 pages.

Composite Panel Report: *Laminate Flooring, Wood Diciest*, Sep. 1999, p. 37, Cygnus Publishing, Inc., & Affiliates, Fort Atkinson, WI, 6 pages.

Wilkes, et al., "Table 5.3 Typical properties of General Purpose Vinyl Plastic Products," PVC Handbook, ISBN 3-446-22714-8, 1988, p. 184.

"Reference: Polymer Properties," Polymer Products from Aldrich, dated 1993, (2 pages).

Laminatfußböden, Technik und Technologien, Laminatforum, 1999, 4 pages including pp. 23-24, Akzo Nobel.

Mobiloil/Holzwerkstoff-Symposium, Stuttgart 1998, Volker Kettler, Witex AG, pp. 1-24.

Ullmann's Encyclopedia of Industrial Chemistry, "Wood," 1996, vol. A28, 9 pages incl pp. 345-350, VCH Verlagsgesellschaft mbH, VCH Publishers, NY, NY.

Soiné, H., Holzwerkstoffe, Herstellung und Verarbeitung; Platten, Beschichtungsstoffe, Formteile, Türen, Möbel; Von Hansgert Soiné; DRW-Verlag, 1995 (51 pages).

Excerpt from Bodenwanddecke, "USA: Das sind die Trends," Apr. 2000, p. 7.

ASTM, Designation: F 1700—96, "Standard Specification for Solid Vinyl Floor Tile," Jul. 1996, pp. 719-721, ASTM International, West Conshohocken, PA, USA.

Azrock Brochure, "Luxury Vinyl Tile," Apr. 1998, 1 page, Azrock, USA.

Nass, Leonard I., Ed., Encyclopedia of PVC, vol. 1, 1976, 4 pages, including pp. 212-213, Tables 3-4, Marcel Dekker, Inc., NY, NY.

*Anlage D4*—Chanda, Manas and Roy, Salil K., Ed., *Plastics Technology Handbook. Third Edition, Revised and Expanded*, 1998, 20 pages including cover, inside cover, p. 171, pp. 271-274, pp. 538-543, pp. 1026-1028, back page; Marcel Dekker, Inc., New York, NY.

*Anlage D6*—Certified U.S. Appl. No. 08/899,118, filed Jul. 23, 1997, 36 pages.

Carpet & Floorcoverings Review, Feb. 1999, CMP Information Ltd., London, England, UK, 8 pages.

ASTM International, Designation: D 2124-99, "Standard Test Method for Analysis of Components in Poly(Vinyl Chloride) Compounds Using an Infrared Spectrophotometric Technique," Sep. 1999, pp. 1-5 and Summary of Changes p. 6—Apr. 2002, ASTM International, West Conshohocken, PA, USA.

Ellison, A.H., et al., "Wettability of Halogenated Organic Solid Surfaces," Journal of Physical Chemistry, Mar. 1954, pp. 260-265, vol. 58 (3), American Chemical Society, USA.

Haslam, J., et al., "The Examination of Polyvinyl Chloride Compositions Containing Polypropylene Adipate," The Analyst Journal, J.B. Attrill, M.A., F.R.I.C., Editor, Dec. 1955, pp. 871-874, vol. 80, No. 957, W. Heifer & Sons, Ltd., Cambridge, England, UK.

Jańczuk, Bronislaw, et al., "The Components of Surface Tension of Liquids and Their Usefulness in Determinations of Surface Free Energy of Solids," Journal of Colloid and Interface Science, Jan. 1989, pp. 59-66, vol. 127, No. 1, Academic Press Inc., Cambridge, MA, USA.

Jańczuk, Bronislaw, et al., "Adhesion of Air Bubbles to Teflon Surfaces in Water," Journal of Colloid and Interface Science, Mar. 1, 1989, pp. 1-6, vol. 128, No. 1, Academic Press, Inc., Cambridge, MA, USA.

Lapčik, L., et al., "Kinetic study of dissolution of poly(vinyl chloride) in tetrahydrofuran, cyclohexanone, cyclopentanone, and N,N-dimethylformamide," Chemicke Zvesti, 1973, pp. 239-248, vol. 27, No. 2, Slovak Academy of Sciences and Slovak Chemical Society, Slovakia.

Matthews, George, "PVC: Production, Properties and Uses," The Institute of Materials, Book 587, 1996, 33 pages, The Institute of Materials, London, England, UK.

Nass, Leonard I., and Heiberger, Charles A., Editors, Encyclopedia of PVC Second Edition, Revised and Expanded, vol. 1: Resin Manufacture and Properties, 1986, 70 pages, Marcel Dekker, Inc., New York, NY, USA.

Nass, Leonard I., Editor, Encyclopedia of PVC Second Edition, Revised and Expanded, vol. 3: Compounding Processes, Product Design, and Specifications, 1992, 6 pages, Marcel Dekker, Inc., New York, NY, USA.

(56) References Cited

OTHER PUBLICATIONS

Salant, Katherine, "Laminates Move Beyond Kitchen," Orlando Sentinel, Dec. 5, 1999, 4 pages (retrieved from Internet Sep. 21, 2017).
Skillicorn, D.E., et al., "Molecular Weight and Solution Viscosity Characterization of PVC," Journal of Vinyl Technology, Jun. 1993, pp. 105-108, vol. 15, No. 2, Wiley-Blackwell, USA.

* cited by examiner

FLOORBOARDS COMPRISING A DECORATIVE EDGE PART IN A RESILIENT SURFACE LAYER

CROSS REFERENCE TO RELATED APPLICATIONS

The present application is a continuation of U.S. application Ser. No. 16/569,894, filed on Sep. 13, 2019, which is a continuation of U.S. application Ser. No. 15/684,129, filed on Aug. 23, 2017, now U.S. Pat. No. 10,450,760, which is a continuation of U.S. application Ser. No. 14/946,080, filed on Nov. 19, 2015, now U.S. Pat. No. 9,765,530, which is a continuation of U.S. application Ser. No. 13/943,464, filed on Jul. 16, 2013, now U.S. Pat. No. 9,222,267, which is a continuation of U.S. application Ser. No. 13/552,357, filed on Jul. 18, 2012, now U.S. Pat. No. 8,511,031, which is a continuation of U.S. application Ser. No. 13/046,011, filed Mar. 11, 2011, now U.S. Pat. No. 8,245,478, which is a continuation of U.S. application Ser. No. 11/649,837, filed on Jan. 5, 2007, now U.S. Pat. No. 7,930,862, and claims the benefit of U.S. Provisional Application No. 60/758,213, filed on Jan. 12, 2006 and the benefit of Swedish Application No. 0600055-8, filed on Jan. 12, 2006. The entire contents of each of U.S. application Ser. No. 16/569,894, U.S. application Ser. No. 15/684,129, U.S. application Ser. No. 14/946,080, U.S. application Ser. No. 13/943,464, U.S. application Ser. No. 13/522,357, U.S. application Ser. No. 13/046,011, U.S. application Ser. No. 11/649,837, U.S. Provisional Application No. 60/758,213 and Swedish Application No. 0600055-8 are hereby incorporated herein by reference.

AREA OF INVENTION

Embodiments of the present invention relate to a set of moisture proof floorboards and flooring with a resilient surface layer comprising a decorative groove and/or a sealing means.

BACKGROUND OF INVENTION

Embodiments of the invention may concern a floorboard comprising a mechanical locking system, formed at least at two opposite edges and a resilient surface layer provided with a decorative groove. The following description of known techniques, problems of known systems and objects and features of embodiments of the invention will above all, as a non-restrictive example, be aimed as the field of the application. It should be emphasized that embodiments of the invention may be used in any floorboard and it could be combined with all types of known locking systems, for example, where the floorboards are intended to be joined using a mechanical locking system connecting the panels in the horizontal and vertical directions on at least two adjacent sides.

It is known that a floorboard with a resilient surface layer can be provided with a decorative joint portion, in the form of a bevel, for example as described in WO 03/012224.

OBJECTS AND SUMMARY

The floorboards with a resilient surface layer with a decorative joint portion known up to now have several disadvantages. It is only possible to provide the edge with a bevel, which is smaller than the thickness of the resilient surface layer. If the bevel is made larger, the bevel extends down to the moisture sensitive core. The resilient layer is normally thin, and therefore it is only possible to produce small bevels, which are barely visible. Another disadvantage is that both joined and adjacent edges of two floorboards have to be provided with the bevel, in order to look attractive and to increase the total width of the decorative joint portion. Known joints between two floorboards with a resilient surface layer also have the problem of penetration of moisture into the joint, which destroys the moisture sensitive core or sub-floor. The problem increases if the floorboards at the joint are provided with bevels, due to accumulating of dirt and moisture at the bottom of the V-shaped grove, formed by the two adjacent bevels, and a remaining thin barrier part of resilient material.

Embodiments of the present invention relate to a moisture-proof flooring and a set of moisture proof floorboards with a resilient surface layer comprising a decorative groove, which provides for embodiments offering advantages. A useful area for the floorboards is public flooring, e.g., in stores, restaurants, ships, hotels, airports, or at home in rooms which are heavily exposed to dirt and therefore often cleaned by mopping. Another useful area is wet-rooms. "Moisture proof floorboard" means that the front face of the floorboard is provided with a moisture proof material and that connecting means and edges of the floorboard are configured to obtain a joint between the floorboard and another adjacent floorboard which is moisture proof.

According to a first aspect, embodiments of the invention provide a set of moisture proof floorboards, comprising a front face, a rear face, a core, connecting means arranged at least at two opposite edges for connecting the floorboard with a similar floorboard, a resilient surface layer at the front face, preferably of rubber or plastic. The resilient surface layer comprises a decorative groove at an edge of the floorboard. The bottom of the decorative groove is essentially flat and parallel to the front face.

An advantage of embodiments of the invention is that there is no limitation of the width of the decorative groove. Even a large decorative groove may be watertight and protect the core or the sub-floor. A second advantage is that only half the amount of edges has to be worked, since it is possible to replace two narrow grooves with one wide groove.

Preferably the edge with the decorative groove comprises, in the resilient layer, a sealing means configured to cooperate with another sealing means in the resilient layer at an edge of another adjacent floorboard, to obtain a sealing. In one embodiment, the sealing means comprises a horizontally extending protrusion and the other sealing means comprises a sideways open groove. In the most preferred embodiment one or both of the sealing means are also provided with a sealing agent.

In another preferred embodiment both of the sealing means comprise a sideways open groove provided with a sealing agent.

Preferably, the connecting means comprise a mechanical locking system formed at least at two opposite edges of the floorboard, which facilitates the joining of a similar floorboard. Mechanical locking systems joined by angling are for instance known from WO 94/26999, which is especially advantageous at the long sides of a rectangular floor, and another locking system especially advantageous at the short sides, particularly when combined with an angling locking system like the one described in WO 94/26999, are described in PCT/SE2005/001586, owner Välinge Innovation AB. Other shapes of floorboards are also possible. The above mentioned combination of locking systems makes it possible to join floor panels by several methods preferably with a single action method, where the long edge is installed with angling and the short edge, which is provided with a flexible tongue, with vertical folding. This combination is also very easy to disassemble. Other mechanical locking systems are also known, and possible to use, including, for example, systems joined by Angling-Angling, Angling-Snapping or Snapping-Snapping. Floorboards with a mechanical locking system are generally laid floating, i.e. without gluing, on an existing subfloor.

It is also possible to use a tongue and a groove joint, usually combined with gluing or nailing or other fastening means.

According to an embodiment of the first aspect the wood based core may be made of MDF or HDF, preferably of a thickness of 6-9 mm. The thickness of the resilient surface layer is preferably 1-3 mm.

According to an embodiment, the resilient surface layer comprises three layers, a transparent wear layer at the top, a decorative intermediate layer and reinforcement layer closest to the core. It is also possible to print a pattern directly at the rear side of the transparent wear layer or at the top of the reinforcement layer. Preferably, the decorative groove is only in the transparent layer and optionally colored, but it is also possible to extend the groove down to the decorative layer or the reinforcement layer. Different colors of the layers create a visual effect by extending the groove down to other layers and no coloring may be needed. Another embodiment is a resilient layer comprising only a transparent layer and a reinforcement layer of, for example, a colored plastic or a cork layer. An alternative is that the decorative layer is a wood veneer or a cork layer or that the resilient surface layer has two layers, a transparent wear layer and reinforcement layer of, for example, cork.

According to a second aspect, embodiments of the invention provide a set of moisture proof floorboards, comprising a front face a rear face, a core, connecting means arranged at least at two opposite edges for connecting the floorboard with a similar floorboard, a resilient surface layer at the front face, preferably of rubber or plastic. A moisture proof floorboard being provided at an edge and in the resilient layer with a sealing means configured to cooperate with a another sealing means in the resilient layer at an edge of another adjacent floorboard, to obtain a sealing.

Preferably the sealing means comprises a horizontally extending protrusion and the other sealing means comprises a sideways open groove. In the most preferred embodiment one or both of the sealing means are provided with a sealing agent.

In another preferred embodiment both of the sealing means comprise a sideways open groove provided with a sealing agent.

The sealing means and the sealing agent increase the resistance of moisture and water penetration into the joint and the core and the aim is to completely seal the joint.

According to a second object, embodiments of the invention provide for a flooring comprising at least two of the floorboards above in the first object, joined along adjacent edges, preferably mechanically.

In view of the above, an objective of embodiments of the invention is to solve or at least reduce the problems discussed above.

In particular, an objective of embodiments of this invention is to provide a flooring and floorboard comprising a resilient surface layer with a decorative groove in the resilient surface layer, wherein the groove is clearly visible. Further, the floorboard is moisture proof and preferably shows great acoustic properties.

All references to "a/an/the [element, device, component, means, step, etc.]" are to be interpreted openly as referring to at least one instance of said element, device, component, means, step, etc., unless explicitly stated otherwise.

DETAILED DESCRIPTION OF EMBODIMENTS

As represented in FIGS. 1*b*-4*c*, the first aspect of the invention relates to a set of moisture proof floorboards and flooring, provided with a resilient surface layer with a decorative groove.

Figure 1A:
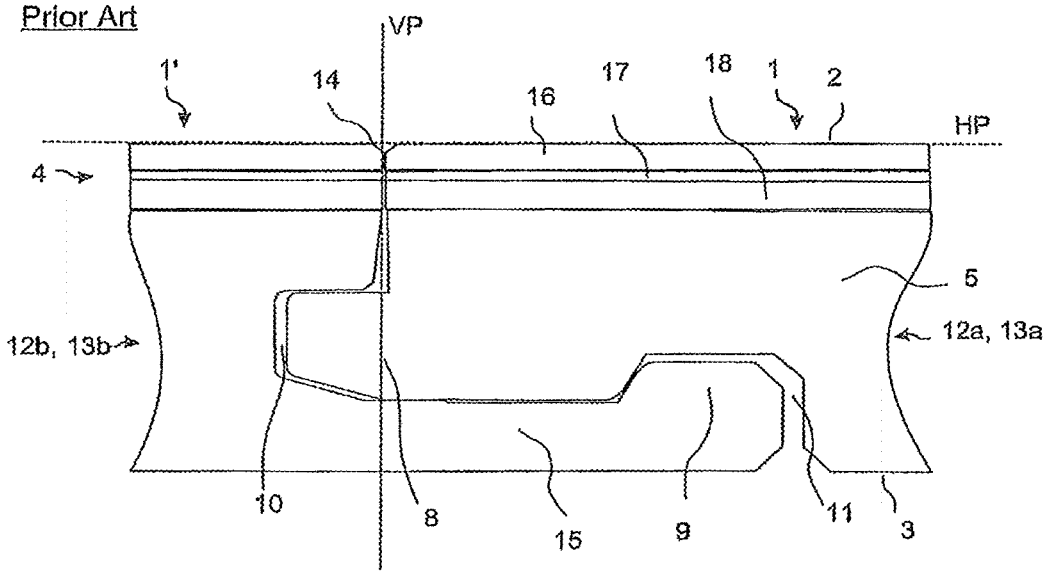
Fig. 1a Prior Art
FIG. 1*a* shows a floorboard with a resilient surface layer and decorative groove known in the art.
Figure 1B:
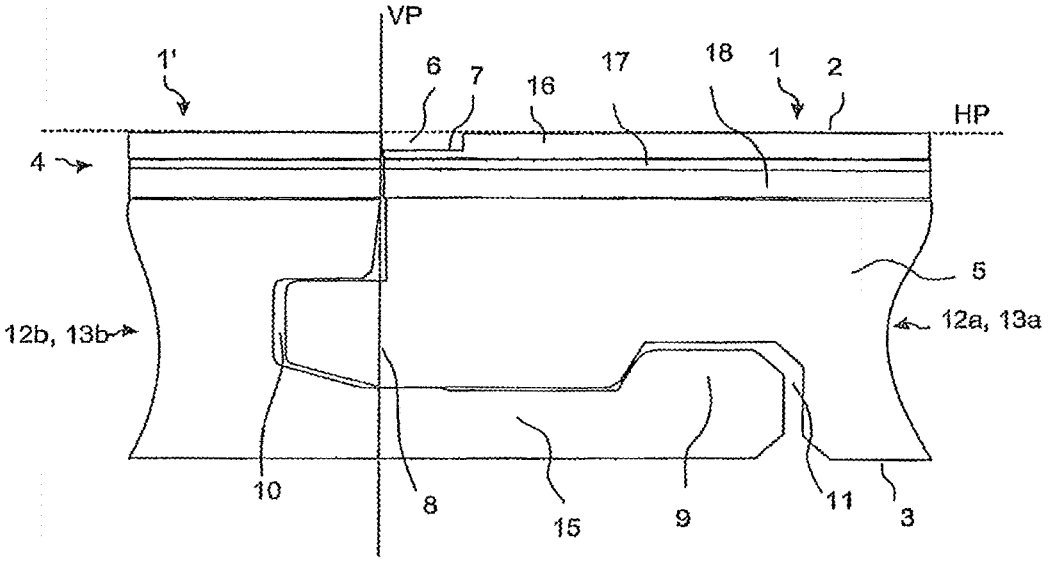
FIG. 1*b* shows a floorboard according to an embodiment of the invention.

FIG. 1*a* show floorboards with decorative joint portions known in the art and described in WO 03/012224. The floorboard 1 comprises a front face 2 and a rear face 3 extending in the direction of the horizontal plane HP, a wood-based core 5 and a resilient surface layer 4 at the front face. The resilient surface layer 4 comprises three different surface layers having different functions. The upper most layer is a transparent, hard and durable wear layer 16 of plastic material, the intermediate layer is a decorative layer 17 of plastic film and the lowest layer is a reinforcement layer 18 which is made of an elastic material and which can be both moisture-proof and sound-absorbing. The decorative layer 17 of plastic film can be replaced with decorative patterns, which are printed directly on the underside of the transparent wear layer 16 or on the upper side of the elastic reinforcement layer 18. The floorboard is provided with a mechanical locking system for locking the floorboards horizontally and vertically at its long and short edges (12*a*, 13*a*, 12*b*, 13*b*) through angling and/or snapping.

According to a first aspect of the invention, as represented in FIGS. 1*b*-4*c*, a floorboard 1 is to be joined with a similar floorboard 1' at adjacent joint edges at a joint plane extending in the vertical plane VP, comprising a front face 2 and a rear face 3 extending in the horizontal plane HP, a core 5, a connecting means arranged at least at two opposite edges for connecting the floorboard with a similar floorboard 1' in a vertical and/or horizontal direction and a resilient surface layer 4, characterized in that at least one edge of the floorboard 1 comprising a decorative groove 6 in the resilient surface layer 4 with a bottom 7 which is essentially parallel to the front face 2. If the floorboard is rectangular, preferably only one of the long edges is provided with the decorative groove; certainly it is also possible to provide one of the long and one of the short edges with the groove 7. Other shapes of the board are also possible, e.g. 3, 5, 6, 7 and 8 edges. The resilient surface layer comprises preferably a transparent wear layer 16 at the top, preferably of a plastic material, an intermediate decorative layer 17 and an elastic reinforcement layer 18 closest to the core 5. The decorative layer 17, preferably of a plastic film can be replaced with decorative patterns, which are printed directly on the underside of the transparent wear layer 16 or on the upper side of the elastic reinforcement layer 18. An alternative is that the decorative layer is a wood veneer or cork layer. According to the embodiment represented in FIG. 1*b*, the groove 7 is only in the transparent layer and optionally the groove is colored.

Preferably the connecting means is a mechanical locking system formed at least at two opposite edges 12*a*, 13*a*, 12*b*, 13*b*. The shown mechanical locking system comprising a locking strip 15 with a locking element 9, a tongue 8 and a tongue groove 10. Other known mechanical locking systems for floorboards are also possible to use such as the tongue lock in FIGS. 4*a*-4*c* or the flexible tongue described in described in PCT/SE2005/001586. The tongue may also be replaced by a displaceable tongue 8' arranged in a displacement grove 54, as shown in FIGS. 5*b* to 6*c*, of the type disclosed in PCT/SE2005/001586 or PCT/SE2006/001218.

There are many alternatives for the number of layers in the resilient layer, the material of the layers and into which layer the groove extends. Some of the alternatives are represented in FIGS. 1*b*-2*d*.

Figure 2A:
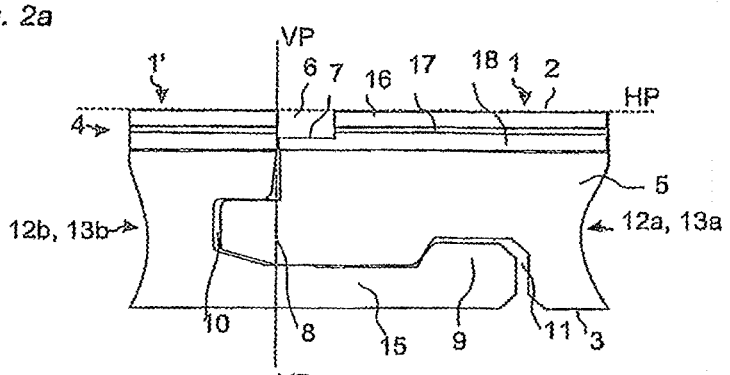
FIGS. 2*a*-2*d* show alternative embodiments of the invention.

The resilient surface layer 4, illustrated in FIG. 2*a*, comprising a transparent surface layer 16, an intermediate decorative layer 17 and a reinforcement layer 18 closest to the core. The groove 6 extends down to the reinforcement layer and is preferably colored. If one of the layers in the resilient layer, represented in FIG. 1*b*-*bd* is of a non-water proof or moisture sensitive material, it is preferred that the groove does not extend into this layer.

Figure 2B:
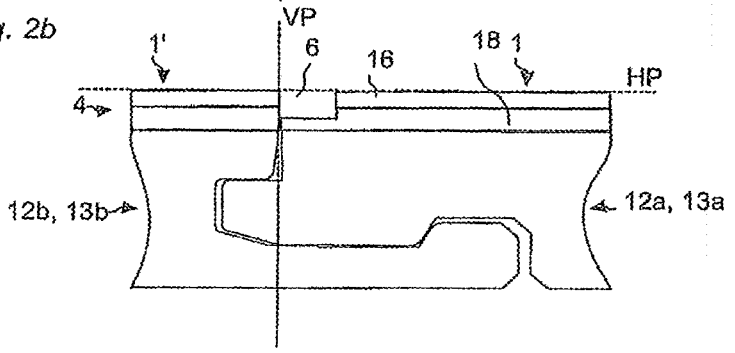

The resilient surface layer 4, illustrated in FIG. 2*b*, is substantially a transparent surface layer 16 and a reinforcement layer closest to the core 18. The groove 6 extends down to the reinforcement layer, preferably of plastic and is preferably colored.

Figure 2C:
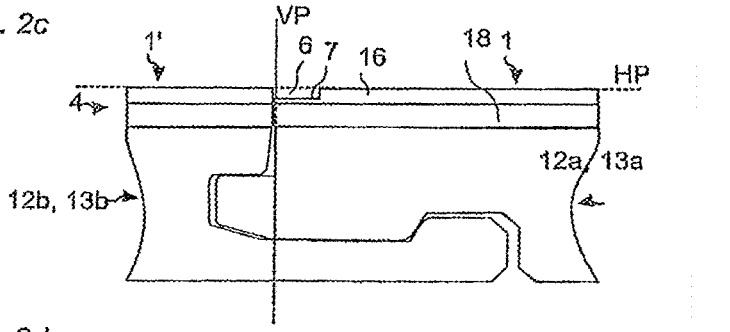

The resilient surface layer 4 illustrated in FIG. 2*c*, is substantially a transparent surface layer 16 and a reinforcement layer closest to the core 18. The groove 6 is only in the transparent layer and is preferably colored. The reinforcement layer is preferably of a colored plastic or a cork layer.

Figure 2D:
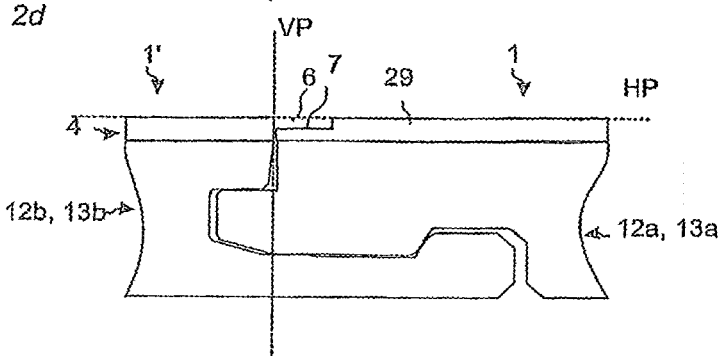

The resilient surface layer 4 in FIG. 2*d*, is substantially only one layer. The groove is preferably colored.

Figure 4A:
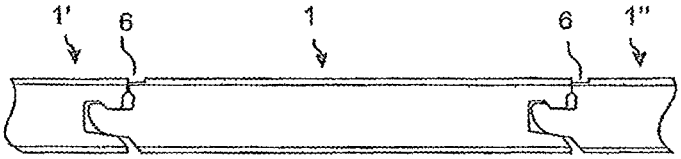
FIGS. 4*a*-4*c* show a floorboard and joined floorboards in different views according to an embodiment of the invention.
Figure 4B:
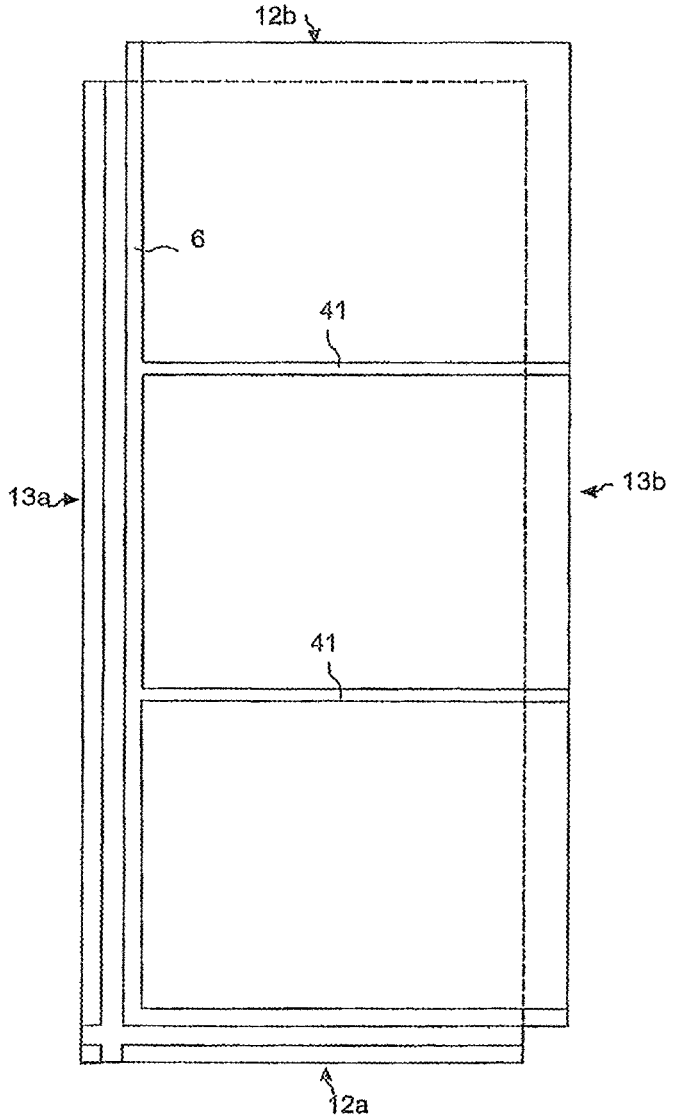
Figure 4C:
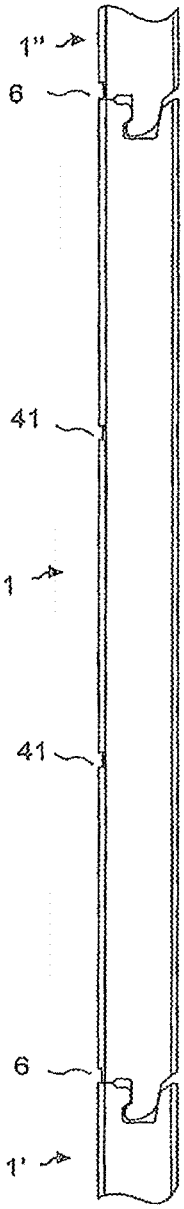

In FIG. 4*b* an embodiment of the invention is represented, comprising a rectangular floorboard 1 with a mechanical locking system at long 13*a*, 13*b* and short edges 12*a*, 12*b* and a decorative groove 6 along only one of the long edges and along only one of the short edges. Additional grooves 41 in the resilient surface layer, between the short edges, are provided. FIG. 4*a* is a cross section of the floorboard in FIG. 6*b*, perpendicular to the long edges, joined to similar floorboards 1' and 1". FIG. 4*c* is a cross section of the floorboard in FIG. 4*b*, perpendicular to the short edges, joined to similar floorboards 1' and 1".

The wood-based core material is preferably a particle, MDF, HDF or plywood board.

As non-limiting example, materials that can be used in a resilient surface layer are acrylic plastic-based materials, elastomers of synthetic rubber, urethane rubber, silicone rubber or the like, polyurethane-based hot-melt adhesive, PVC or polyethylene.

The decorative groove may be made by chemical or mechanical working, preferably cutting or grinding. It is also possible to color the groove. If grinding is used it is possible to make a very shallow groove or even just change the roughness and the brightness of the surface. The grinding method is applicable also to a laminate flooring with a surface layer of resin-impregnated sheets. Another technique is to cut off a part of the resilient surface layer, or cut it to the desirable shape before attaching it to the core, and replace it with another resilient layer of different color or structure.

A second aspect of the invention, as illustrated in FIG. 5*a*-6*c*, is a set of essentially identical moisture proof floorboards 1 each comprising a sealing means at an edge. Each floorboard comprises a front face and a rear face extending in the horizontal plane HP, a core, a connecting means 8, 9, 10, 11, 15, 8', 54 arranged at least at two opposite edges for connecting a floorboard with a another floorboard 1' in a vertical and/or horizontal direction and a resilient surface layer 4. A moisture proof floorboard comprising, at an edge and in the resilient layer 4, a sealing means 51 configured to cooperate with another sealing means 52 in the resilient layer at an edge of another adjacent floorboard, to obtain a sealing.

Figure 5A:
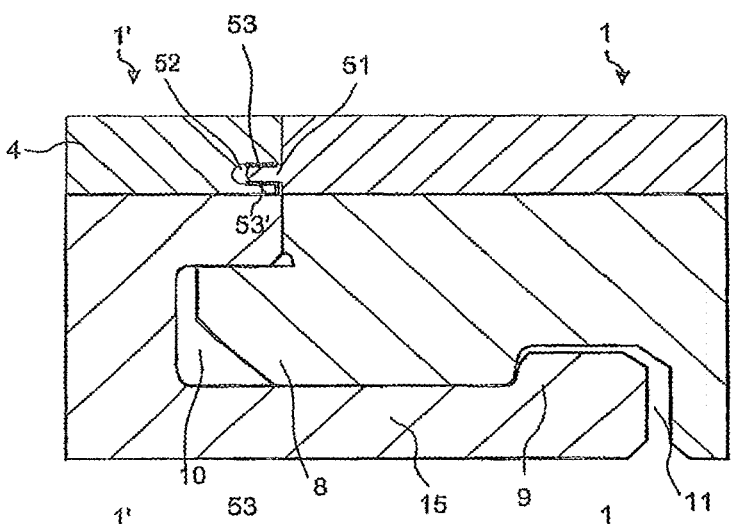
FIGS. 5*a*, 5*c* show joined floorboards according to embodiments of the second aspect of the invention.
Figure 5B:
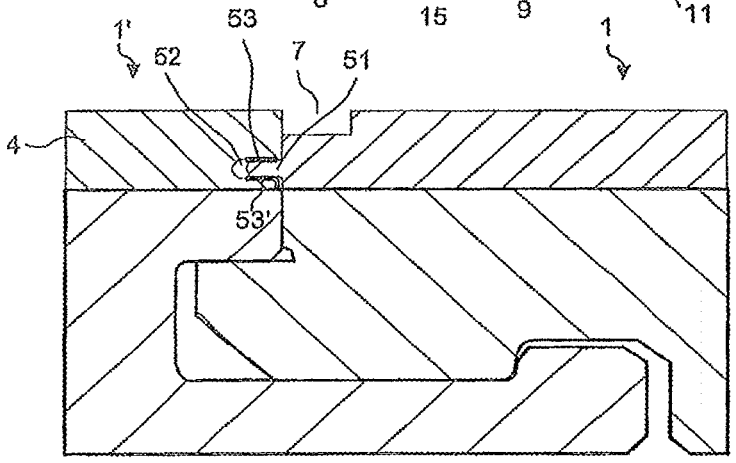
FIG. 5*b* shows an embodiment of a floorboard, according to the first aspect provided with a sealing means according to the second aspect.

The sealing means may comprise a horizontally extending protrusion and the other sealing means may comprise a sideways open groove, as shown in FIG. 5*a*. In the most preferred embodiment one or both of the sealing means are provided with a sealing agent 53.

Figure 6A:
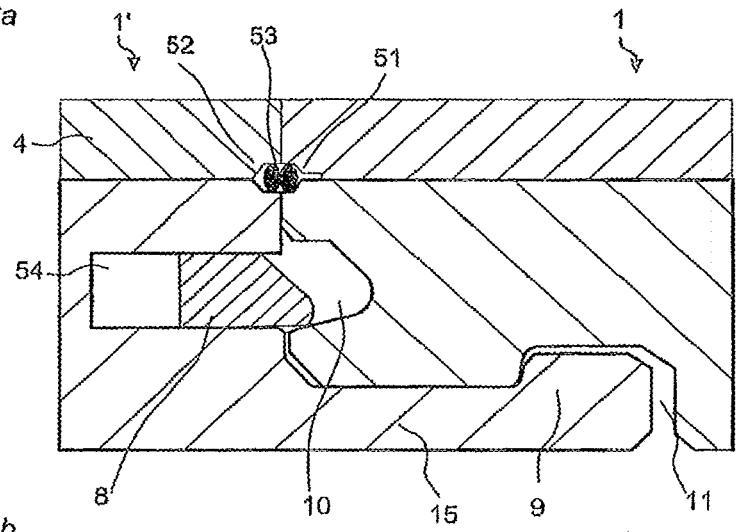
FIGS. 6*a*-6*c* show joined floorboards according to embodiments of the second aspect of the invention.

In another embodiment, shown in FIG. 6*a*, both the sealing means 51, 52 comprise a sideways open groove provided with a sealing agent 53.

Figure 5C:
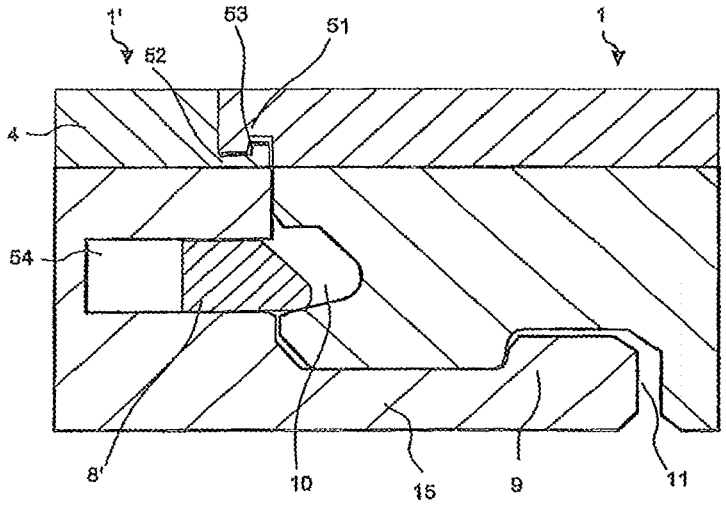

In FIG. 5*c* an embodiment of the sealing means is illustrated comprising overlapping edges, preferably provided with a hook shaped connection 51, 52. A sealing agent 53 may also be provided.

The sealing agent may comprise wax, grease, oil or bitumen. A preferred sealing agent comprises a mix of paraffin wax and paraffin oil. Another example is a micro wax and a natural or synthetic rubber strip.

Figure 6B:
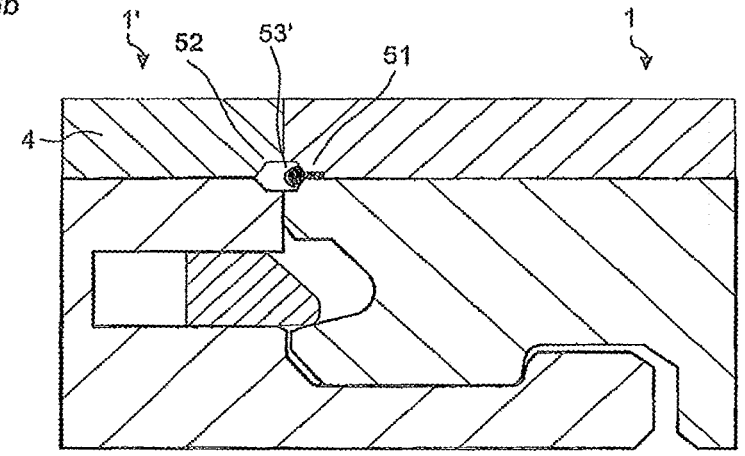
Figure 6C:
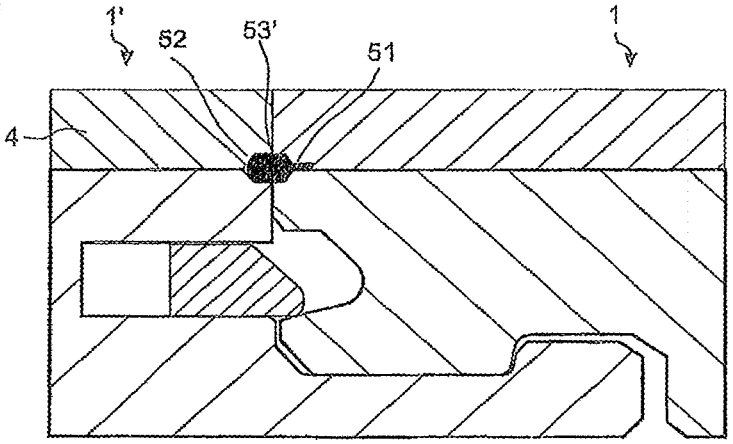

In FIG. 6*b* an embodiment of the sealing means is illustrated comprising an expandable sealing agent 53', arranged at a sideways open groove 51 in the resilient layer 4. The sealing agent is configured to expand into a sideways open groove 52 in the resilient layer of an adjacent floor panel, as illustrated in FIG. 6*c*, after that the two panels are connected to each other by the connecting means. An example of an expandable sealing agent 53' is a strip, preferably of polyurethane, provided with tape, which is removed just before the connection of the two adjacent floorboards. Other examples are materials, which expand when exposed to moisture.

The first aspect of the invention, comprising a decorative groove 7, may be combined with the second aspect, comprising sealing means 51, 52, as illustrated in 5*b*.

Figure 3:
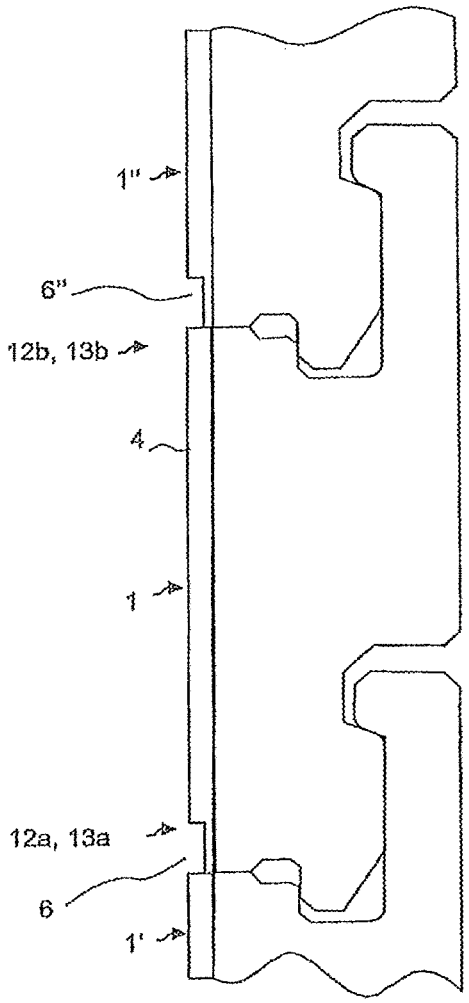
FIG. 3 shows three joined floorboards according to an embodiment of the invention.

A second object of the invention, represented by FIGS. 3 and 4, is a flooring comprising a set of the floorboards 1, 1', according to the first and/or second aspect, joined along adjacent edges, preferably mechanically.

In the most preferred embodiment, only one of the edges 12*a*, 13*a*, 12*b*, 13*b* of the two joined and adjacent edges is provided with the decorative groove.

Embodiments of the invention have mainly been described above with reference to a few embodiments. However, as is readily appreciated by a person skilled in the art, other embodiments than the ones disclosed above are equally possible within the scope of the invention, as defined by the appended patent claims.

Generally, all terms used in the claims are to be interpreted according to their ordinary meaning in the technical field, unless explicitly defined otherwise herein.

The invention claimed is:

1. A set of essentially identical floorboards each comprising a front face and a rear face extending in a horizontal plane, a core, a connector arranged at least at two opposite edges for connecting one of the floorboards with another floorboard in a vertical and/or horizontal direction, and a resilient surface layer possessing elastic resilience, wherein each floorboard comprises a decorative groove between the opposite edges, said decorative groove being visible when one of the floorboards is connected with another floorboard by said connector, wherein the decorative groove comprises a bottom which is essentially parallel to the front face, wherein the resilient surface layer comprises an elastic reinforcement layer providing the elastic resilience to the resilient surface layer and wherein the bottom of the decorative groove is disposed within the elastic reinforcement layer.

2. The set of essentially identical floorboards as claimed in claim 1, wherein the floorboards are moisture proof.

3. The set of essentially identical floorboards as claimed in claim 1, wherein a width of the decorative groove is larger than a thickness of the resilient surface layer.

4. The set of essentially identical floorboards as claimed in claim 1, wherein the core of each floorboard comprises a wood-based material.

5. A system as claimed in claim 4, wherein the core comprises HDF, MDF, particleboard or plywood.

6. The set of essentially identical floorboards as claimed in claim 1, wherein the connector is a mechanical locking system.

7. The set of essentially identical floorboards as claimed in claim 6, wherein the mechanical locking system is formed in the edges of each floorboard.

8. The set of essentially identical floorboards as claimed in claim 1, wherein the resilient surface layer further comprises a plastic material layer.

9. The set of essentially identical floorboards as claimed in claim 8, wherein the plastic material layer includes PVC or polyethylene.

10. The set of essentially identical floorboards as claimed in claim 1, wherein the resilient surface layer further comprises a decorative layer.

11. The set of essentially identical floorboards as claimed in claim 10, wherein the decorative layer is a plastic film, a wood veneer, a cork layer or a print.

12. The set of essentially identical floorboards as claimed in claim 1, wherein the elastic reinforcement layer is a layer of the resilient surface layer positioned closest to the core of each floorboard.

13. The set of essentially identical floorboards as claimed in claim 1, wherein the resilient surface layer comprises substantially only one layer of a moisture proof material.

14. A set of essentially identical floorboards each comprising a front face and a rear face extending in a horizontal plane, a core, a connector arranged at least at two opposite edges for connecting one of the floorboards with another floorboard in a vertical and/or horizontal direction, and a resilient surface layer possessing elastic resilience, wherein each floorboard comprises a decorative groove between the opposite edges, said decorative groove being visible when one of the floorboards is connected with another floorboard by said connector, wherein the decorative groove comprises a bottom which is essentially parallel to the front face, wherein the resilient surface layer comprises a transparent wear layer, and wherein the bottom of the decorative groove is disposed within the transparent wear layer.

15. A set of essentially identical floorboards each comprising a front face and a rear face extending in a horizontal plane, a core, a connector arranged at least at two opposite edges for connecting one of the floorboards with another floorboard in a vertical and/or horizontal direction, and a resilient surface layer possessing elastic resilience, wherein each floorboard comprises a decorative groove between the opposite edges, said decorative groove being visible when one of the floorboards is connected with another floorboard by said connector, wherein the decorative groove comprises a bottom which is essentially parallel to the front face, and wherein the opposite edges comprise a sealing arrangement in the resilient surface layer.

16. The set of essentially identical floorboards as claimed in claim 15, wherein the sealing arrangement comprises a horizontally extending protrusion and a sideways open groove which are configured to cooperate with each other.

17. The set of essentially identical floorboards as claimed in claim 16, wherein the sealing arrangement comprises a sealing agent.

18. The set of essentially identical floorboards as claimed in claim 17, wherein the sealing agent comprises paraffin wax or paraffin oil.

* * * * *